US009518423B2

(12) United States Patent
Seuberling et al.

(10) Patent No.: US 9,518,423 B2
(45) Date of Patent: Dec. 13, 2016

(54) PLINTH FOR WINDOW SCREEN INSTALLATION SYSTEM

(71) Applicant: Home Improvement Systems, Inc., Cincinnati, IN (US)

(72) Inventors: David Seuberling, Cincinnati, OH (US); Michael Tompkins, Cherryville, NC (US)

(73) Assignee: Home Improvement Systems, Inc., Cincinnati, OH (US)

( * ) Notice: Subject to any disclaimer, the term of this patent is extended or adjusted under 35 U.S.C. 154(b) by 0 days.

(21) Appl. No.: 14/451,849

(22) Filed: Aug. 5, 2014

(65) Prior Publication Data

US 2016/0040472 A1 Feb. 11, 2016

(51) Int. Cl.
*E06B 9/62* (2006.01)
*E06B 9/52* (2006.01)

(52) U.S. Cl.
CPC ..... *E06B 9/52* (2013.01)

(58) Field of Classification Search
CPC ..... E06B 9/52; E06B 3/48; E06B 7/00; E06B 9/00
USPC ..... 52/204.53, 204.54, 63, 222, 656.7; 160/380, 381, 382, 395, 403
See application file for complete search history.

(56) References Cited

U.S. PATENT DOCUMENTS

| | | | | |
|---|---|---|---|---|
| 918,676 | A | 4/1909 | Johnson | |
| 1,285,073 | A * | 11/1918 | Fredman | B42D 5/005 225/27 |
| 1,586,708 | A | 6/1926 | Sandelin | |
| 2,784,781 | A * | 3/1957 | Rhoades | E06B 9/52 160/371 |
| 3,469,695 | A | 9/1969 | Greeninger | |
| 3,696,857 | A | 10/1972 | Tarte | |
| 3,960,197 | A * | 6/1976 | Daniels | B41F 15/36 160/371 |
| 3,980,555 | A | 9/1976 | Freissle | |
| 4,189,880 | A | 2/1980 | Ballin | |
| 4,234,035 | A | 11/1980 | Babbs | |
| 4,333,284 | A | 6/1982 | Meadows | |
| 4,658,522 | A | 4/1987 | Kramer | |
| 4,690,192 | A | 9/1987 | Stilling | |
| 5,666,773 | A | 9/1997 | Librande et al. | |
| 5,904,200 | A | 5/1999 | Agen | |
| 6,032,433 | A | 3/2000 | Hatziathanasiou | |
| 6,378,267 | B1 | 4/2002 | Bass | |

* cited by examiner

*Primary Examiner* — Willam Gilbert
(74) *Attorney, Agent, or Firm* — Indiano & McConnell LLC

(57) ABSTRACT

A window screen installation system is disclosed that includes a screen frame configured in a generally rectangular configuration from a plurality of screen frame extrusions. A plurality of trim molds are included that are configured to snap into place over the screen frame extrusion. When respective ends of the trim molds are positioned adjacent one another they form a plurality of generally rectangular shaped openings. A plurality of plinths are configured to be positioned in each of the plurality of openings configured to further secure the trim molds to the screen frame extrusions.

19 Claims, 11 Drawing Sheets

PLINTH FOR WINDOW SCREEN INSTALLATION SYSTEM

BACKGROUND

It is well known that most screens manufactured today include a replaceable screen fabric. In the event the fabric is torn, stretched, or otherwise damaged, the fabric is removed and replaced with another such fabric. Typically this task is accomplished by removing a gasket-type device from within a recess formed around the perimeter of a frame. The gasket retains the fabric edges within the recess such that when the gasket is removed, the fabric is likewise removed. A new fabric is then stretched across the frame and the gasket is replaced within the recess. Excess fabric along the perimeter of the screen—and specifically that material along the perimeter of the fabric and on the side away from the gasket—is then trimmed.

Although this is a simplistic procedure to describe, it is well known that stretching the fabric and maintaining it in a stretched manner while the gasket is replaced is a difficult task. What typically occurs when the appropriate tools are not available is that as the gasket is forced into place, the fabric loosens or is pulled in a direction such as to create wrinkles. Further, due to the tension on the fabric during installation, it is often difficult to force the gasket into the recess without damaging the fabric, or without releasing the tension on the fabric.

One such solution to this problem can be found in U.S. Pat. No. 6,378,267 to Bass, which has been assigned to the applicant. As the system disclosed in the '267 Patent has been used, it has become apparent that a need exists for a way in which to allow the installer to cut the ends of the frames and trim molds square instead of mitered which creates a gap between the ends of the two frame pieces once installed. The gap between the ends of the mitered frame pieces is not aesthetically appealing. Further, this manner of mating the two frame pieces together does not provide any manner of further securing the trim molds to the frames.

DESCRIPTION OF ILLUSTRATIVE EMBODIMENTS

Figure 1:
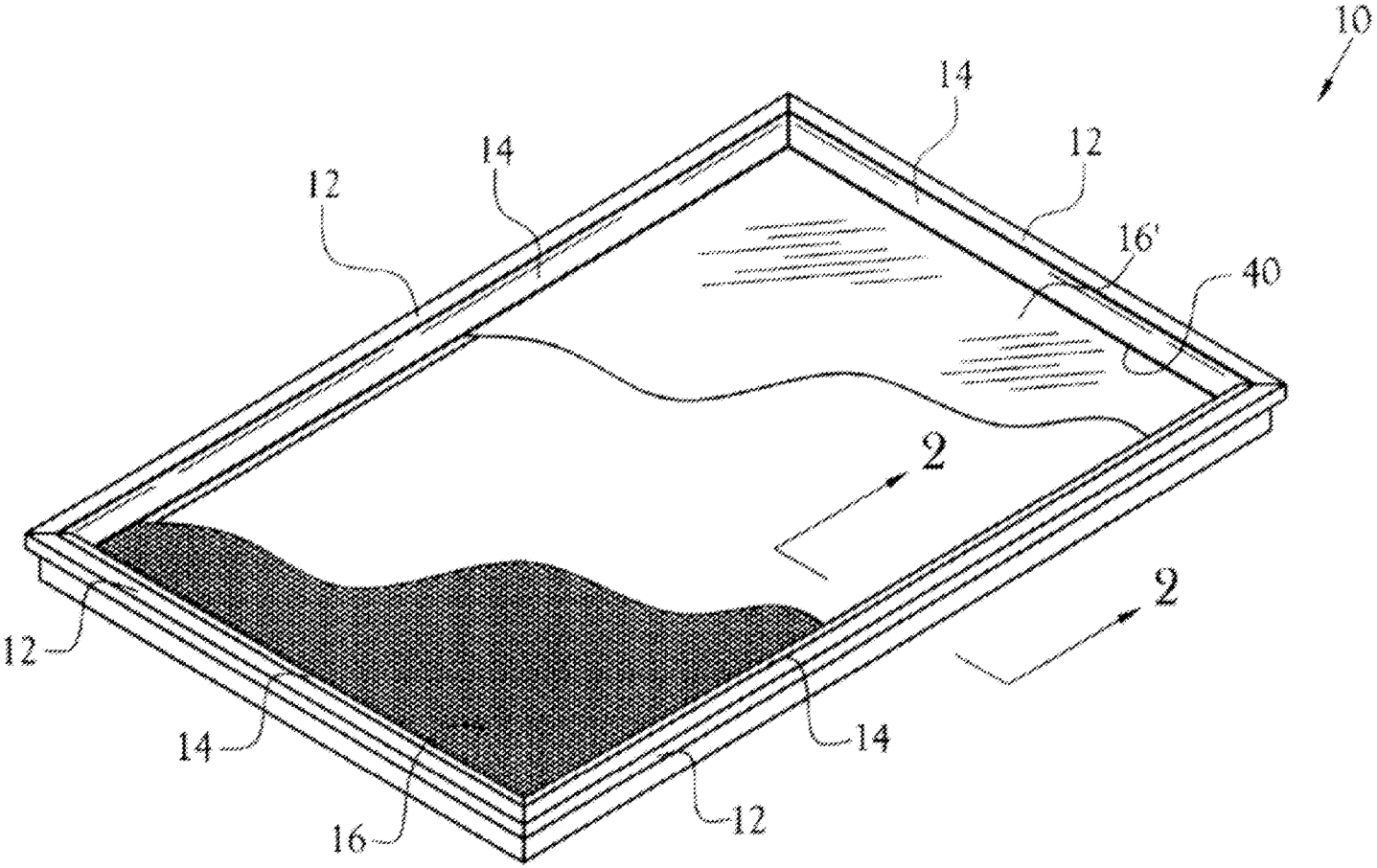
FIG. 1 is a perspective view of the window screen installation system.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

A window screen installation system incorporating various features of the present invention is illustrated generally at 10 in the figures. The window screen installation system 10, which primarily includes a screen frame 12 and trim mold 14, is designed for releasably mounting a screen fabric 16 or other pliable sheet material in such a manner as to self-tighten the fabric or material during installation. While a hammer may be used to secure the trim mold 14 to the screen frame 12, tightening of the screen or fabric 16 is accomplished without the use of any tools. Moreover, the screen frame 12 and trim mold 14 are designed to allow for the mounting of the screen or fabric 16 without damaging the same such that it may be removed and reused as required.

A screen fabric 16 may be installed for use in such applications as a storm door or a window screen, or for larger applications such as screened-in porches. However, in colder seasons, it may be preferable to replace the screen fabric 16 with a transparent sheet material 16' such as vinyl. Accordingly, the present invention is designed to allow for the replacement of the screen fabric 16 with the sheet material 16', and vise versa. For ease of description, use of the term "screen 16" is intended to include a conventional screen fabric 16, a conventional transparent sheet material 16', or any other pliable sheet that may be used as a membrane in the screen frame 12.

Illustrated in FIG. 1 is a perspective view of a screen frame 12 of the present invention. In order to illustrate the various uses of the screen frame 12, a portion of a screen fabric 16 is shown in the lower portion of the frame 12, while a portion of a transparent sheet material 16' is shown in the upper portion of the screen frame 12. Thus it is clearly seen that the screen frame 12 and trim mold 14 are designed for use in various environments and applications.

Figure 2:
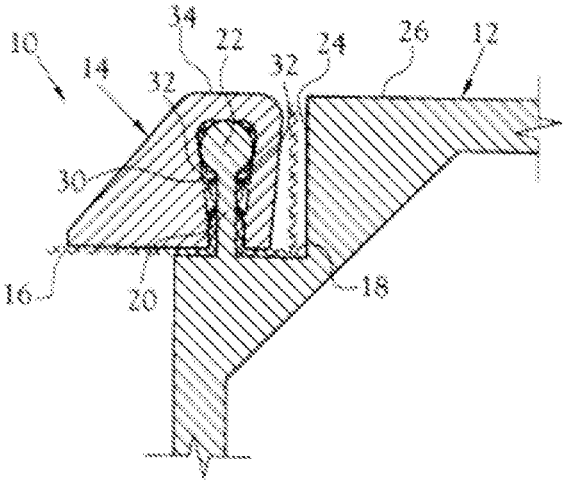
FIG. 2 is an elevation view, in section, of the window screen installation system taken at 2-2 in FIG. 1.

As more clearly illustrated in FIG. 2, the screen 16 is disposed and held securely in place between the screen frame 12 and the trim mold 14. To accomplish the disposition and retention of the screen 16, the screen frame 12 and trim mold 14 are each extruded members. The screen frame extrusion 12 defines a mounting surface 18 preferably disposed below and parallel to an exterior face 26. A vertical surface 24 extends between and perpendicular to the exterior face 26 and the mounting surface 18. A mounting rib 20 extends along the mounting surface 18 and parallel to the vertical surface 24. The mounting rib 20 terminates below the exterior face 26. A bead 22 is defined at the terminal edge of the mounting rib 20 to serve as a locking mechanism.

The trim mold 14 is configured to closely receive the mounting rib 20 of the screen frame extrusion 12. To this extent, the trim mold 14 defines a channel opening 30 on the bottom surface thereof and extending into the trim mold 14 a depth substantially equal to the height of the mounting rib 20. A plurality of retention barbs 32 disposed at an upward angle with respect to the mounting rib 20 are formed in the channel 30 to engage the mounting rib bead 22 in order to prevent inadvertent removal of the trim mold 14 from the mounting rib 20.

Further, the trim mold 14 is configured to be received within a volume defined generally by the vertical surface 24 and the mounting surface 18 of the screen frame extrusion 12. In one form, the trim mold 14 defines an exterior face 34 which is disposed substantially co-planar with the screen frame extrusion 12 when installed. Such disposition is accomplished by equating the thickness of the trim mold 14 from the extent of the channel 30 to the trim mold exterior face 34 with the difference in the height of the screen frame extrusion vertical surface 24 less the height of the mounting rib 20 and bead 22. In one form, as described, the height of the mounting rib 20 and bead 22 and the depth of the channel 30 are substantially equal. Accordingly, in order to accomplish the co-planar relationship of the screen frame extrusion exterior face 26 and the trim mold exterior face 34, the overall height of the trim mold 14 is substantially equal to the height of the screen frame extrusion vertical surface 24. However, it will be understood by one skilled in the art that other configurations may be as suitable in particular applications.

In order to install a screen 16 in the screen frame 12 of the present invention, the screen 16 is laid over the screen frame extrusion 12 at approximately the point to be attached. The trim mold 14 is then placed over the mounting rib 20 and pressed toward the screen frame extrusion 12 such that the screen 16 is deformed over the mounting rib 20 and the mounting rib 20 and screen 16 are both received within the trim mold channel 30. The screen 16 is thus tightly received between the mounting rib 20 and the channel 30, with the retention barbs 32 assisting in the retention thereof. In order to remove the screen 16, the trim mold 14 is simply pried away from the screen frame extrusion 12 with, for example, a flat head screwdriver. Thus, mounting and removal of the screen 16 typically do not damage the screen 16 as a result of not requiring the use of conventional fasteners such as screws.

Figures 3, 4, 5, 6:
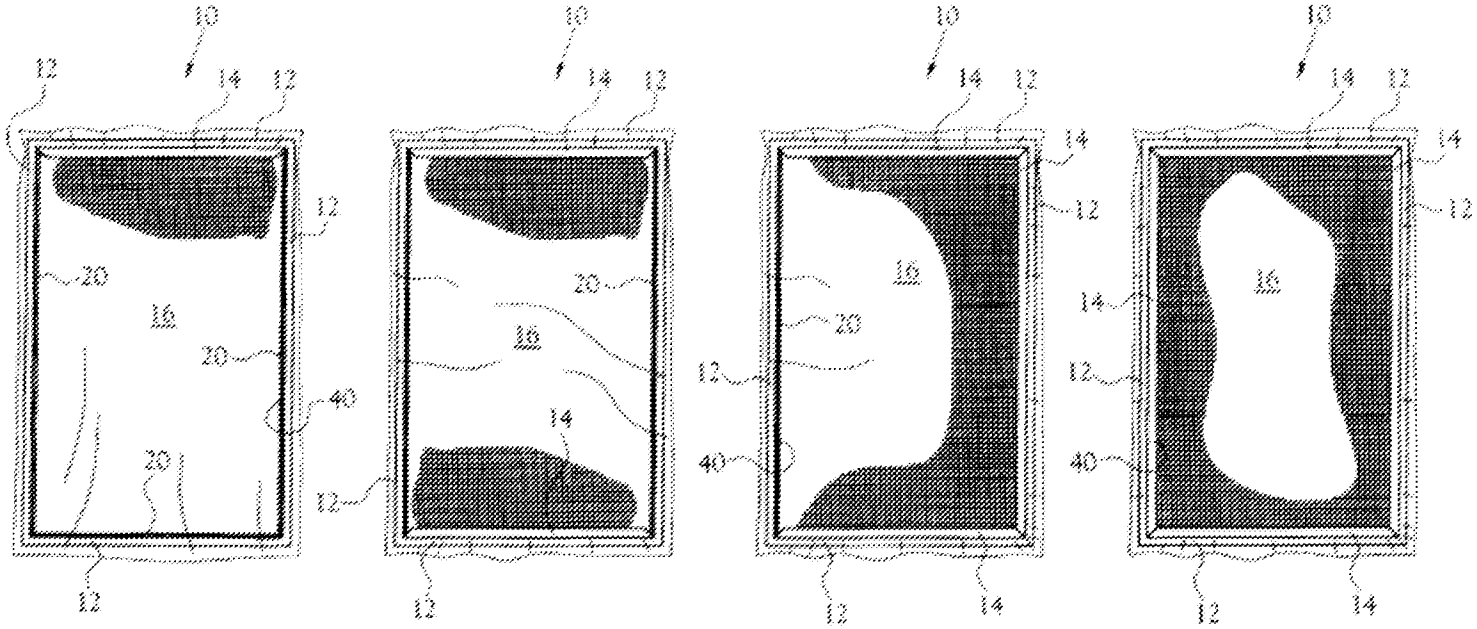
FIG. 3 is a top view plan view of the window screen installation system showing a first trim mold mounted thereon.
FIG. 4 is a top view plan view of the window screen installation system showing a second trim mold mounted thereon.
FIG. 5 is a top view plan view of the window screen installation system showing a third trim mold mounted thereon.
FIG. 6 is a top view plan view of the window screen installation system showing a fourth trim mold mounted thereon.

FIGS. 3-6 illustrate in a step-by-step fashion the installation of a screen 16 on a screen frame 12. As illustrated in FIG. 3, a screen 16 dimensioned at least slightly larger than the opening 40 defined by the screen frame 12 is positioned on top of the screen frame 12 and the trim mold 14 corresponding to a first screen frame extrusion 12 is snapped into place. Then as illustrated in FIG. 4, the opposing trim mold 14 is snapped into place. Prior to snapping the trim mold 14 into place, the screen 16 is gently pulled to remove excess slack. However, slack approximately equal to the height of the mounting rib 20 is automatically removed from the screen 16 when the second trim mold 14 is placed. By placing opposing trim molds 14 in this manner, slack is removed from the screen 16 in an end-to-end fashion, with some slack remaining side-to-side. FIGS. 5 and 6 illustrate a similar procedure from side to side to remove the remaining slack and to complete the screen mounting process. With the placement of each of the third and fourth trim molds 14, slack approximately equal to the height of the mounting rib 20 is taken from each side of the screen 16, leaving a tightened screen mounted on the screen frame 12.

Figure 7:
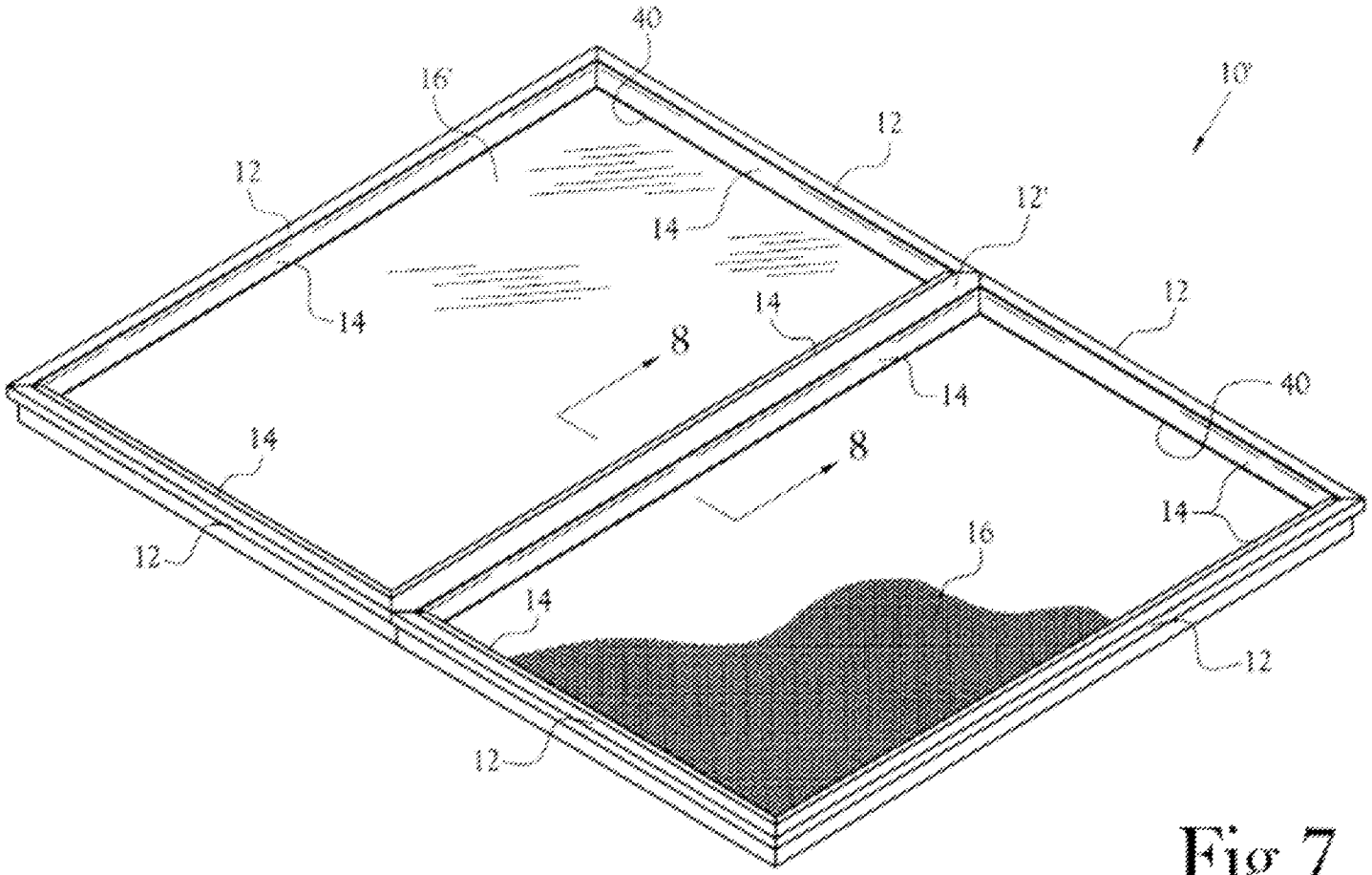
FIG. 7 is a perspective view of an alternative window screen installation system.
Figure 8:
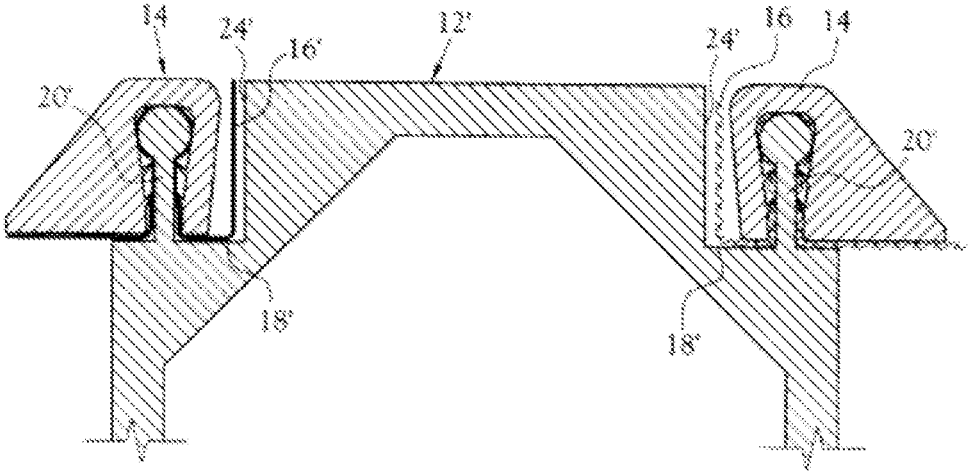
FIG. 8 is an elevation view, in section, of the window screen installation system taken at 8-8 in FIG. 7.

FIGS. 7 and 8 illustrate generally a further embodiment of the screen frame 10' of the present invention wherein the screen frame extrusion 12' defines a symmetrical configuration such as to include opposing mounting ribs 20'. In this embodiment, as illustrated in FIG. 7, successive screen panels 16 are installed for uses such as side-by-side windows, screened-in patios, or the like. Illustrated for purposes of clarifying a variety of uses of the screen frame 10' of the present invention, one panel is shown to be a screen fabric 16, while the other panel is shown to be a transparent material 16' such as vinyl. As best illustrated in FIG. 8, the screen frame extrusion 12' defines opposing vertical surfaces 24', mounting surfaces 18' and mounting ribs 20'. Each, however, functions in similar fashion to that of the previously described embodiment.

Figure 9:
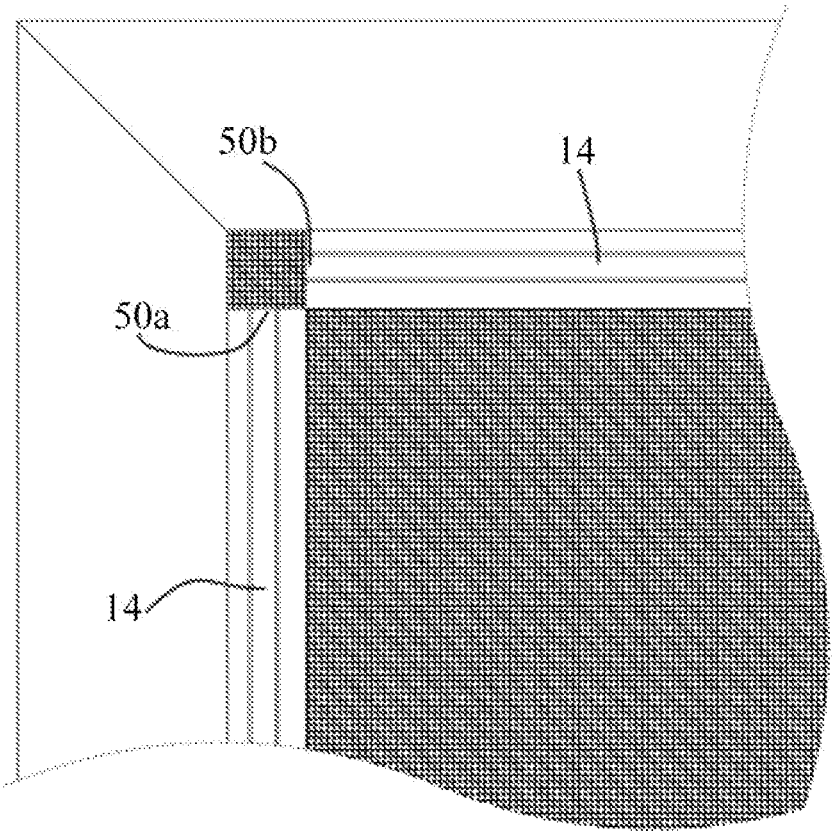
FIG. 9 illustrates a corner portion of a window screen installation system showing to trim molds adjacent to one another defining a generally rectangular shaped opening.

Referring to FIG. 9, a pair of trim molds 14 are illustrated connected with a pair of screen frames 12 (not illustrated, see e.g. FIG. 2) that are mounted on a mounting surface. As illustrated, the trim molds 14 are snapped onto the screen frames 12 thereby securing the screen panel 16 to the screen frames 12. In this form, respective ends 50*a*, 50*b* of the trim molds 14 are positioned adjacent one another thereby leaving a generally square shaped gap or opening between the ends 50*a*, 50*b* of the trim molds 14.

Figure 10:
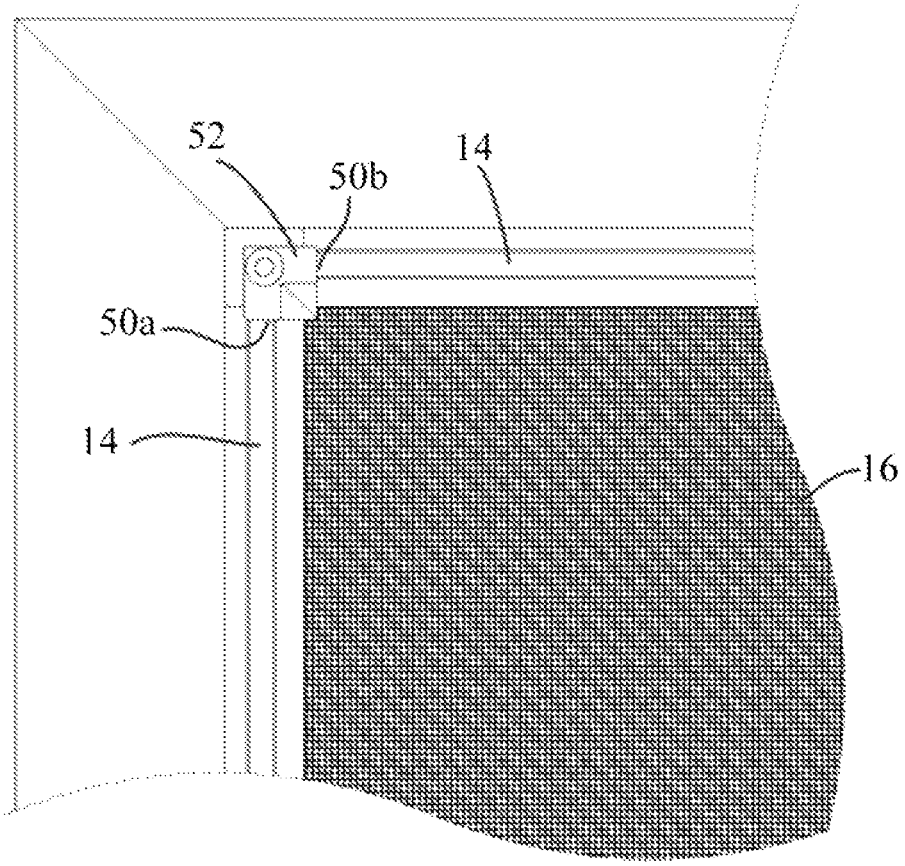
FIG. 10 illustrates a corner portion of a window screen installation system showing to trim molds adjacent to one another showing a plinth installed over the respective ends of the adjacent trim molds.
Figure 11:
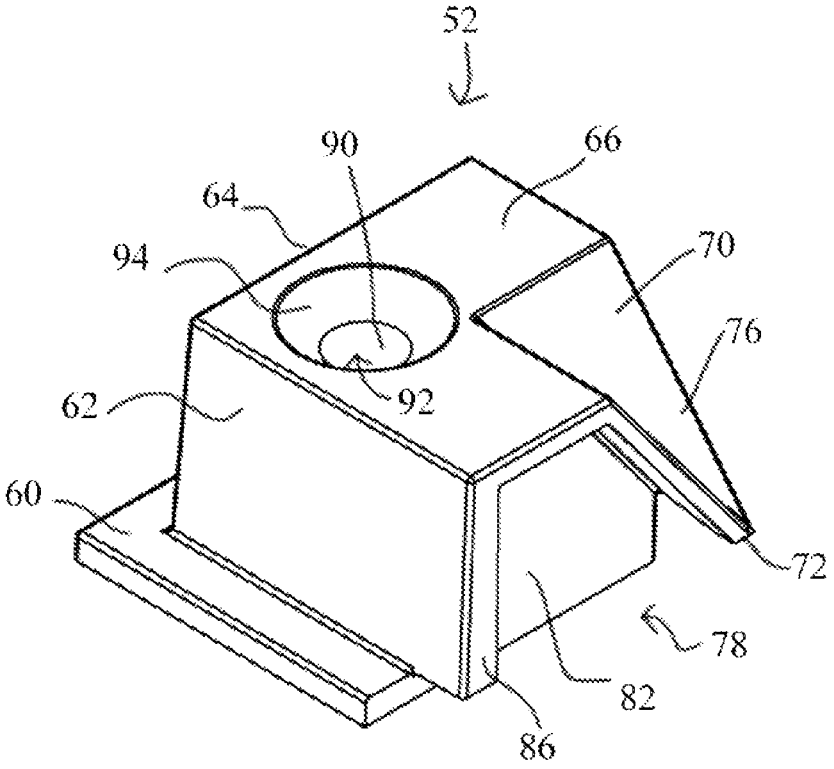
FIG. 11 is a perspective view of a plinth used in the window screen installation system.

Referring to FIG. 10, a plinth 52 is positioned over a portion of the ends 50*a*, 50*b* of the trim molds 14. The plinth 52 is used to help further secure the trim molds 14 to the screen frames 12. In one form, the plinth 52 is secured to the ends 50*a*, 50*b* of the trim molds 14 by a securing mechanism 54, such as a screw in one form. The securing mechanism 54 is screwed into the mounting surface. It should be appreciated that in other forms the plinth 52 could be secured to the trim molds 14 using other securing mechanisms, such as glue or an epoxy. The plinth 52 completes the corner between the two respective trim molds 14.

Referring collectively to FIGS. 11-14, more detailed views of the plinth 52 is illustrated. The plinth 52 includes a base portion 60 that runs horizontally in relation to first and second vertical outer wall 62, 64 that extend upwardly or vertically from the base portion 60. The first and second vertical outer walls 62, 64 extend upwardly toward and are connected with an upper portion or surface 66 that runs perpendicular with the base portion 60. In one form, the upper portion 66 has a generally L-shaped configuration.

Figure 12:
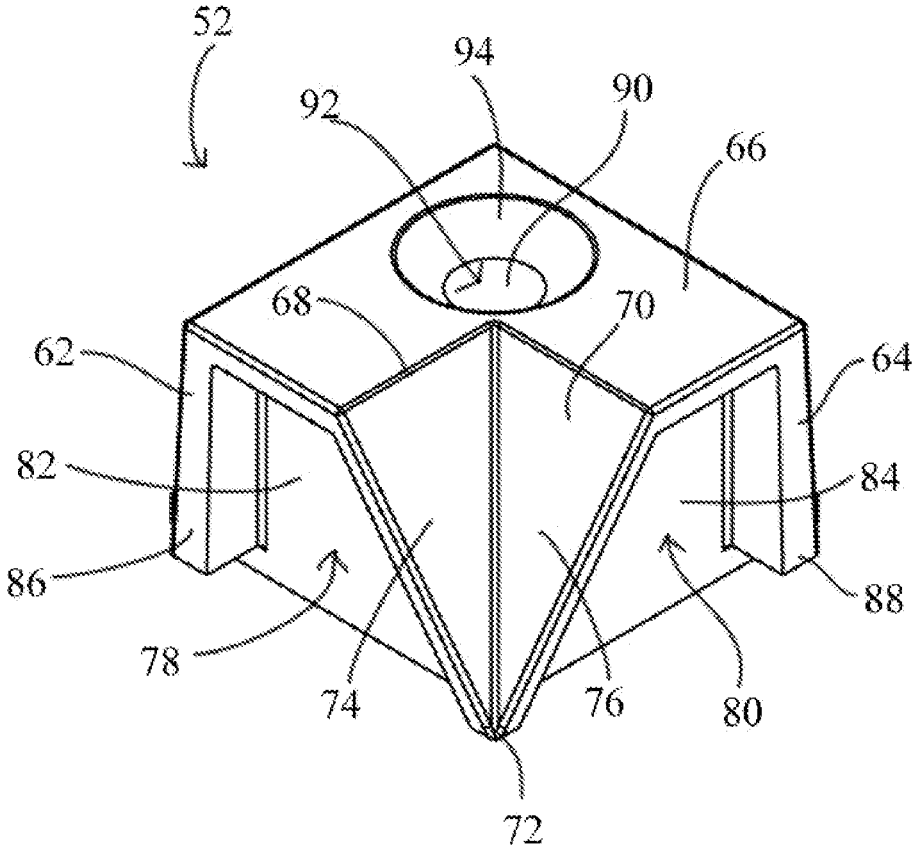
FIG. 12 is another perspective view of the plinth used in the window screen installation system.
Figure 13:
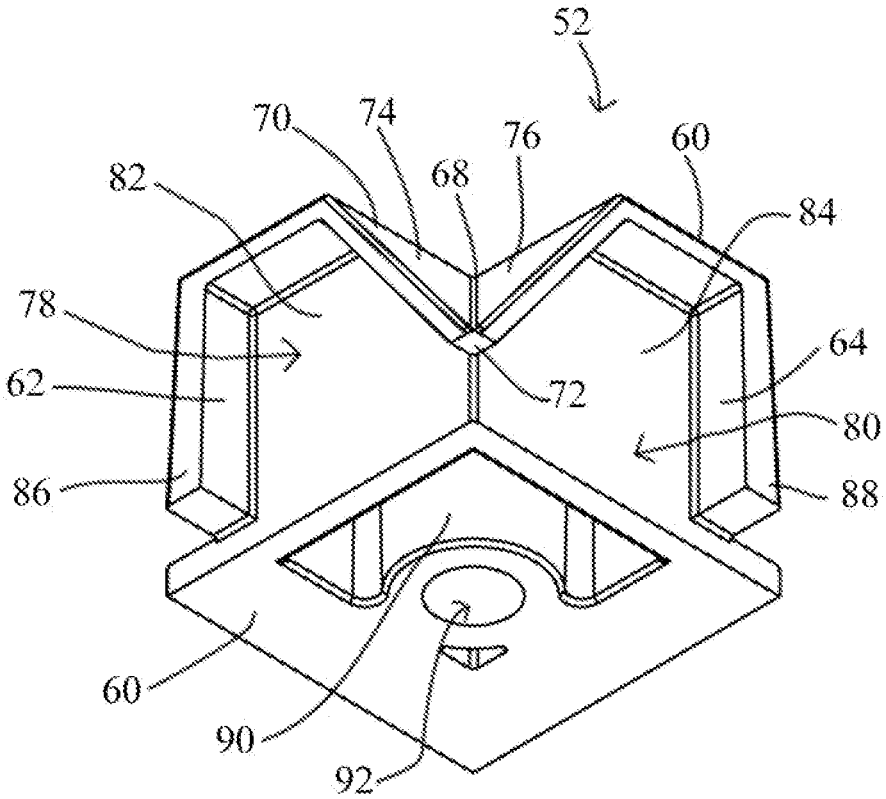
FIG. 13 is another perspective view of the plinth used in the window screen installation system.
Figure 14:
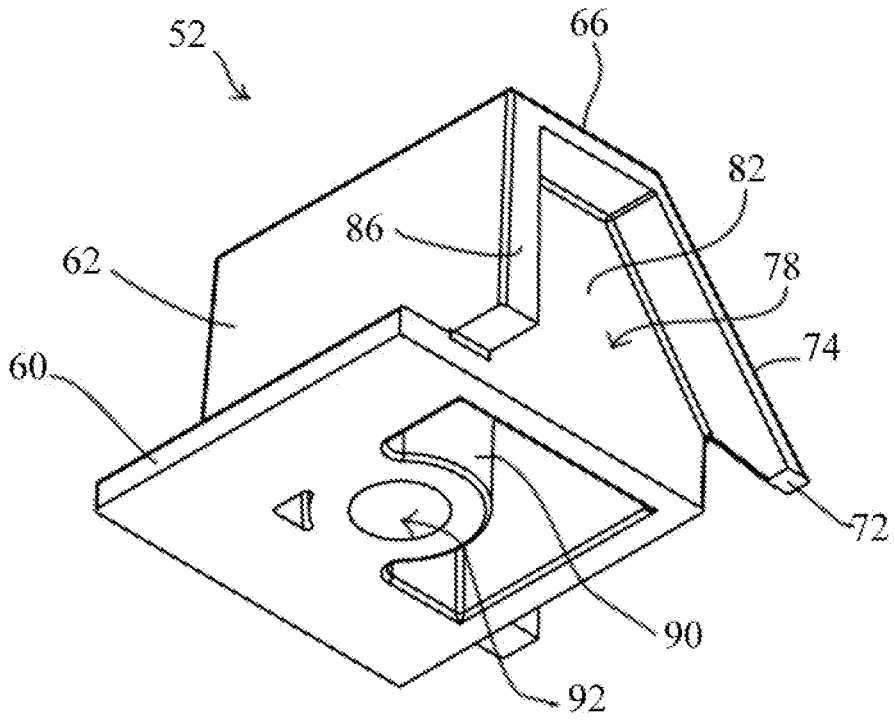
FIG. 14 is yet another perspective view of the plinth used in the window screen installation system.

As illustrated best in FIG. 12, an inside portion 68 of the upper portion 66 includes a tapered portion 70 that extends downwardly and outwardly toward a tapered end 72. The inside portion 68 begins at about the center of the upper portion 66 and extends outwardly in two directions toward outside edges of the upper portion 66. In one form, the tapered portion 70 comprises a first tapered portion 74 and a second tapered portion 76. As illustrated, the first and second tapered portions 74, 76 have a generally triangular shape. In one form, the first and second tapered portions 74, 76 taper outwardly from the upper portion 66 at an angle of approximately 127°. As illustrated, the first and second tapered portions 74, 76 taper downwardly and converge at the tapered end 72.

The first tapered portion 74, a portion of the upper surface 66, and a portion of the first vertical outer wall portion 62 define a first trim mold receiving cavity 78. The second tapered portion 76, a portion of the upper surface 66, and a portion of the second vertical outer wall portion 64 define a second trim mold receiving cavity 80. The first and second trim mold receiving cavities 78, 80 are configured to be shaped like the upper surface of the trim mold 14. A first recessed vertical wall portion 82 is included within the first trim mold receiving cavity 78. A second recessed vertical wall portion 84 is included within the second trim mold receiving cavity 80. In one form, the first and second recessed vertical wall portions 82, 84 are recessed from outer edges 86, 88 of the first and second vertical outer wall portions 62, 64 by approximately ⅛ of an inch. As such, the first and second vertical outer walls 62, 64 extend away from the base portion 60 approximately ⅛ of an inch. As illustrated in FIG. 10, the ends 50*a*, 50*b* of the trim molds 14 are configured to be received in the first and second trim mold receiving cavities 78, 80.

As illustrated in FIGS. 11-14, the plinth 52 includes a securing member housing 90 that includes an aperture 92 running through the securing member housing 90. The securing member housing 90 extends from a lower surface of the upper surface 66 to a lower surface of the base 60. In one form, the aperture 92 is sized and configured to receive a #8 flat head screw. In addition, the upper surface 66 of the plinth 52 includes a countersink 94. In one form, the countersink 94 is sized and configured to receive the head of a #8 flat head screw. Those skilled in the art would recognize that other sizes could be used in other forms of the invention.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A window screen installation system, comprising:

a screen frame having a generally rectangular configuration and constructed from a plurality of screen frame extrusions mounted to a mounting surface, each screen frame extrusion cooperating to form an opening across which is positioned a screen, each screen frame extrusion defining at least one mounting surface and at least one mounting rib extending upwardly from said mounting surface and parallel to an interior edge of said screen frame extrusion, said mounting rib defining a bead along a terminal end of said mounting rib;

a plurality of trim molds each configured to closely receive said mounting rib of said screen frame extrusion and said screen, wherein said bead is configured to resist penetration of said screen, said plurality of trim molds defining a bottom surface and a channel opening thereon and extending into said trim molds a depth substantially equal to a height of said mounting rib, wherein respective ends of said plurality of trim molds are positioned adjacent one another thereby forming a plurality of generally rectangular shaped openings exposing a portion of said mounting surface; and a plurality of plinths configured to be positioned in each of said plurality of openings configured to further secure said trim molds to said screen frame extrusions, wherein each said plinth comprises a horizontal base having a first vertical outer wall and a second vertical outer wall extending upwardly from said base to a horizontal upper surface, wherein a first end of said first vertical outer wall extends beyond a first edge of said base and a second end of said upper surface extends beyond said first edge of said base thereby defining a first trim mold receiving cavity, wherein a third end of said second vertical outer wall extends beyond a second edge of said base and a fourth end of said upper surface extends beyond said second edge of said base thereby defining a second trim mold receiving cavity, wherein said first and second trim mold receiving cavities are each configured to receive a portion of an end of a respective one of said trim molds.

2. The window screen installation system of claim 1, wherein an inside portion of said upper surface includes a tapered portion that extends downwardly and outwardly from said upper surface.

3. The window screen installation system of claim 1, wherein said tapered portion comprises a first tapered portion and a second tapered portion extending to a tapered end.

4. The window screen installation system of claim 3, wherein said first and second tapered portions having a generally triangular shape.

5. The window screen installation system of claim 3, wherein said first tapered portion forms a part of said first trim mold receiving cavity and said second tapered portion forms a part of said second trim mold receiving cavity.

6. The window screen installation system of claim 5, wherein said first and second trim mold receiving cavities are configured to have the shape of an upper surface of said trim mold.

7. The window screen installation system of claim 5, further comprising a first recessed vertical wall positioned in said first trim mold receiving cavity and a second recessed vertical wall positioned in said second trim mold receiving cavity.

8. The window screen installation system of claim 1, further comprising a securing member housing extending from a lower surface of said upper surface to a lower surface of said base, wherein an aperture runs through the securing member housing.

9. The window screen installation system of claim 8, wherein said upper surface includes a countersink associated with said securing member housing.

10. A window screen installation system, comprising:

a screen frame having a generally rectangular configuration constructed from at least one screen frame extrusion, each said screen frame extrusion cooperating to form an opening across which is positioned a screen, each said screen frame extrusion defining at least one mounting surface and at least one mounting rib extending upwardly from said mounting surface and parallel to an interior edge of said screen frame extrusion, said mounting rib defining a bead along a terminal end of said mounting rib;

a plurality of trim molds each having a channel configured to closely receive said mounting rib of said screen frame extrusion and said screen, wherein said trim mold is configured to snap into place over said mounting rib of said screen frame extrusion, wherein said bead is configured to resist penetration of said screen, wherein respective ends of said plurality of trim molds are positioned adjacent one another thereby forming a plurality of generally rectangular shaped openings; and a plurality of plinths configured to be positioned in each of said plurality of openings configured to further secure said trim molds to said screen frame extrusions, wherein each said plinth comprises a horizontal base having a first vertical outer wall and a second vertical outer wall extending upwardly from said base to a horizontal upper surface, wherein a first end of said first vertical outer wall extends beyond a first edge of said base and a second end of said upper surface extends beyond said first edge of said base thereby defining a first trim mold receiving cavity, wherein a third end of said second vertical outer wall extends beyond a second edge of said base and a fourth end of said upper surface extends beyond said second edge of said base thereby defining a second trim mold receiving cavity, wherein said first and second trim mold receiving cavities are each configured to receive a respective end of a respective one of said trim molds.

11. The window screen installation system of claim 10, wherein an inside portion of said upper surface includes a tapered portion that extends downwardly and outwardly from said upper surface.

12. The window screen installation system of claim 10, wherein said tapered portion comprises a first tapered portion and a second tapered portion extending to a tapered end.

13. The window screen installation system of claim 12, wherein said first tapered portion forms a part of said first trim mold receiving cavity and said second tapered portion forms a part of said second trim mold receiving cavity.

14. The window screen installation system of claim 12, wherein said first and second tapered portions having a generally triangular shape.

15. The window screen installation system of claim 14, wherein said first and second trim mold receiving cavities are configured to have the shape of an upper surface of said trim mold.

16. The window screen installation system of claim 14, further comprising a first recessed vertical wall positioned in said first trim mold receiving cavity and a second recessed vertical wall positioned in said second trim mold receiving cavity.

17. The window screen installation system of claim 10, further comprising a securing member housing extending from a lower surface of said upper surface to a lower surface of said base, wherein an aperture runs through the securing member housing.

18. The window screen installation system of claim 17, wherein said upper surface includes a countersink associated with said securing member housing.

19. A window screen installation system, comprising:

a screen frame configured in a generally rectangular configuration from a plurality of screen frame extrusions, each said screen frame extrusion cooperating to form an opening across which is positioned a screen, wherein each said screen frame extrusion defines at least one mounting surface and at least one mounting rib extending upwardly from said mounting surface and parallel to an interior edge of said screen frame extrusion, said mounting rib defining a bead along a terminal end of said mounting rib;

a plurality of trim molds each having a channel configured to closely receive said mounting rib of said screen frame extrusion and said screen, wherein said trim mold is configured to snap into place over said mounting rib of said screen frame extrusion, wherein said bead is configured to resist penetration of said screen, wherein respective ends of said plurality of trim molds are positioned adjacent one another thereby forming a plurality of generally rectangular shaped openings; and a plurality of plinths configured to be positioned in each of said plurality of openings configured to define a corner.

* * * * *